United States Patent [19]

Watson

[11] 4,209,066

[45] Jun. 24, 1980

[54] METHOD AND APPARATUS FOR RUNNING TUBULAR GOODS INTO AND OUT OF A BOREHOLE

[76] Inventor: Barry R. Watson, P.O. Box 756, Monahans, Tex. 79756

[21] Appl. No.: 961,570

[22] Filed: Nov. 17, 1978

[51] Int. Cl.[2] ..... B25B 13/50; E21B 19/06

[52] U.S. Cl. ..... 166/315; 166/77.5; 173/147; 175/171

[58] Field of Search ..... 175/171; 166/315, 77.5; 173/147, 164

[56] References Cited

U.S. PATENT DOCUMENTS

| | | | |
|---|---|---|---|
| 2,781,185 | 2/1957 | Robbins | 173/147 X |
| 3,239,016 | 3/1966 | Alexander | 166/315 X |
| 3,280,920 | 10/1966 | Scott | 173/164 X |
| 3,299,957 | 1/1967 | O'Neill et al. | 166/77.5 |
| 3,404,741 | 10/1968 | Gheorghe et al. | 166/77.5 X |
| 3,680,412 | 8/1972 | Mayer et al. | 173/147 X |
| 3,949,818 | 4/1976 | Russell | 166/314 X |

*Primary Examiner*—Stephen J. Novosad
*Attorney, Agent, or Firm*—Marcus L. Bates

[57] ABSTRACT

This invention is used in conjunction with a small drilling rig having a traveling head. The apparatus enables the rig to accommodate much longer joints of casing than is otherwise possible, and avoids damage to the threads at the box and pin end of the joint. An upper and lower elevator is provided, along with an adaptor apparatus by which one of the elevators can be attached to the traveling head of the rig. In going into the hole, one elevator is attached to the upper end of a joint, the adaptor apparatus is attached to and lifted by the traveling head, and lowered until the elevator engages the rig floor. Thereafter the head is removed from the elevator so that the elevator supports the box end of the joint at the rig floor. The other elevator is of similar construction and is attached to the upper end of another joint. The head lifts the joint into the derrick so that the pin end thereof can be mated to the box end of the first joint, thereby providing a string located within the borehole. The lower elevator is attached to rig structure, while the upper elevator is rotated by the head, thereby making up the threads. The lower elevator is removed from the string and placed on still another joint, while the head lowers the string into the hole. This operation is continued until the entire string has been made up. The string is removed from the borehole and broken out in the reverse manner.

13 Claims, 7 Drawing Figures

METHOD AND APPARATUS FOR RUNNING TUBULAR GOODS INTO AND OUT OF A BOREHOLE

BACKGROUND OF THE INVENTION

Oilwell boreholes must be cased before the well is completed. The casing string runs from the surface of the earth down to the production formation in most instances, and often an additional, shorter casing string is run from the surface of the ground several hundred feet downhole below the lowest aquifer. The casing is bonded to the borehole with cement and great care is taken to make certain that there is no possibility of one formation contaminating another formation.

The casing is usually run with a relatively small drilling rig, such as an Ingersoll Rand T5 rig, for example. Sometimes special casing rigs are employed, and at other times, the casing is run with a large drilling rig, which, of course, is very expensive.

Small drilling rigs which have a traveling powered head are limited to the length of casing which can be accommodated. Casing joints are manufactured especially for the small rig and this joint is identified as a Range 1 casing joint having a 20 foot length. Larger, more expensive rigs accommodate Range 2 casing joints which are about 30 feet in length.

Each joint of casing has a coupling member, called a collar, secured to one end of each joint. This provides the joint with a pin end and a box end. It is customary to lift the box end, that is, the end of the joint having the collar attached thereto, up into the rig, and thereafter lower the joint so that the pin end engages the box end of the joint which is already in the hole. The joint is screwed onto the upper end of the string and the entire string lowered into the borehole, with this action continuing until the well has been properly cased.

It is customary to screw a sub into the box end of the casing joint and attach the sub to the traveling head so that the joint can be lifted into the derrick where the pin end is subsequently stabbed into the box end of the string. A backup tool is generally used to prevent the casing string in the hole from rotating, while a set of specially designed power tongs are used to engage and screw the joint onto the upper end of the casing string. This operation requires a considerable number of roughnecks and represents one of the most dangerous aspects of running casing into the hole. The repeated use of the sub causes undesirable wear of the threads and preferably is to be avoided, because the worn threads sometime fail and drop the string into the hole, which is considered catastrophic in the oil patch.

It would be desirable to be able to provide a new system of running casing into the ground wherein a small drilling rig can accommodate casing longer than 20 feet in length. It would furthermore be desirable to be able to avoid damaging the threaded ends of the casing by lifting the casing into the derrick and thereafter rotating the new joint of casing without attachments being applied to the threads of the box end. It would especially be desirable if these attributes could be accomplished with a reduced work force and reduced time, thereby effecting a considerable savings. Such a desirable expedient is possible by the practice of the present invention.

SUMMARY OF THE INVENTION

The method and apparatus of the present invention enables a relatively small drilling rig to run relatively long joints of casing into a borehole. The drilling rig preferably is of the type which has a traveling power head. The apparatus includes a sliptype elevator which prevents relative rotation of the casing string and additionally includes support means thereon which engages the collar of a joint of casing and supports the casing string from the rig floor as well as enabling a joint of casing to be lifted by the rig.

An adaptor apparatus connects one elevator to the traveling power head in such a manner that rotational motion can be imparted into the elevator. A second elevator of similar construction is employed for supporting the string from the rig floor and within the borehole.

An elevator is placed at the box end of a joint of casing, the elevator is connected to the traveling head by the adaptor apparatus, and the joint of casing is lifted into the derrick so that the pin end thereof can be stabbed into the box end of the string of casing located in the borehole. Hence the method of this invention requires the use of an upper and lower elevator.

The lower elevator is supported from the rig floor and held against rotation. The power head is rotated to make up the new joint respective to the string, so that the new joint becomes part of the string located within the borehole. The lower elevator is removed, the power head lowers the string until the upper elevator rests on the floor of the drilling rig, thereby becoming the lower elevator. The previously removed elevator is attached to another joint of casing and again attached to the power head by the adaptor apparatus, thus becoming the upper elevator. The new joint is picked up and stabbed into the upper box of the string. This operation continues until the entire string is ready to be cemented into the borehole.

In coming out of the hole, the casing string is broken out by reversing the above procedure.

Accordingly, a primary object of the present invention is the provision of method and apparatus for running casing into a borehole.

Another object of the invention is to provide a method of running casing into a borehole by the use of an upper and lower elevator in conjunction with a drilling rig having a traveling power head associated therewith.

A further object of this invention is to disclose and provide apparatus for running casing into and out of a borehole without using attachments for the box and pin threads.

A still further object of this invention is the provision of apparatus for attachment to the box end of a string of casing which frictionally engages the exterior of the casing to prevent rotation thereof and simultaneously supports the casing by utilizing lifting means attached at the collar shoulder.

Another and still further object of this invention is to disclose and provide a combination elevator and adaptor apparatus by which the box end of a joint of casing can be removably secured to the traveling power head of a drilling rig.

An additional object of the present invention is the provision of method and apparatus in combination with a relatively small drilling rig having a traveling power head associated therewith, which enables the drilling rig to accommodate relatively long joints of casing in a manner which heretofore has been unknown.

These and other objects are attained in accordance with the present invention by the provision of a method of running tubular goods in and out of a borehole by the use of apparatus fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
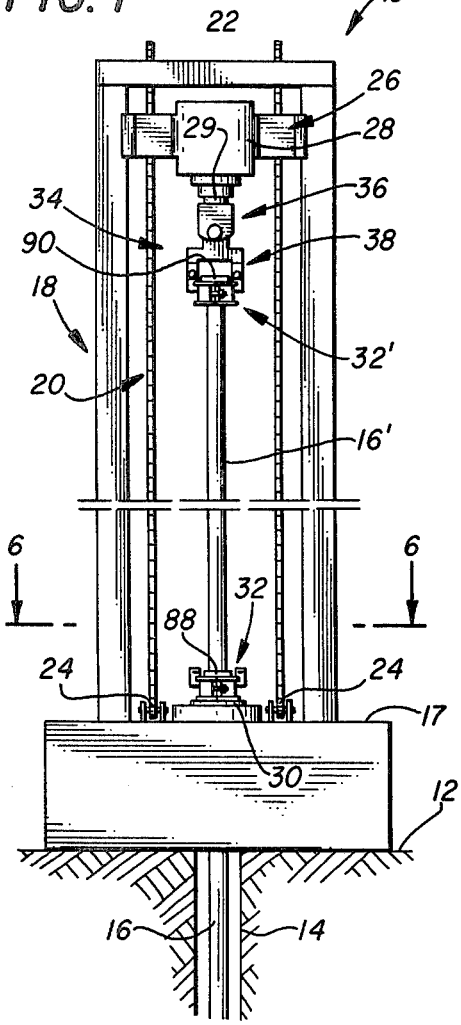
FIG. 1 is a broken, side elevational view of a drilling rig in combination with apparatus made in accordance with the present invention.

In FIG. 1 there is disclosed a drilling rig 10 supported from the ground 12 for forming shallow boreholes 14, and subsequently running a string of casing 16 into the borehole, thereby enabling the well to be completed. The drilling rig has a floor 17 and the usual derrick 18. A hydraulically actuated chain lifting device 20 includes spaced-apart sprockets 22 and 24 for vertically lifting a traveling, powered drilling head 26 within the derrick. The powered head has a hydraulic motor 28 to which there is attached a rotatable member 29.

The floor is apertured and includes an annular support base 30 which is adapted to accommodate any number of different tools, including a bowl for a conventional set of slips. As seen in FIG. 1, together with other figures of the drawings, an annular base abuttingly receives the lower annular base of a slip-type elevator 32 made in accordance with the present invention. An upper slip-type elevator 32' supports an upper joint of casing 16'.

Figure 2:
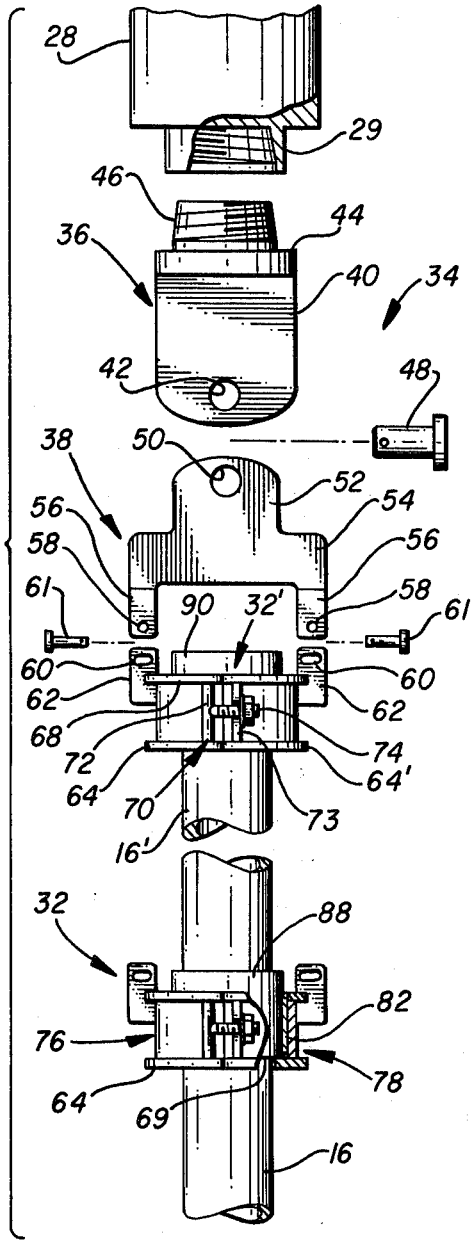
FIG. 2 is an enlarged, broken, part cross-sectional, disassembled view which discloses part of the apparatus seen in FIG. 1.
Figure 6:
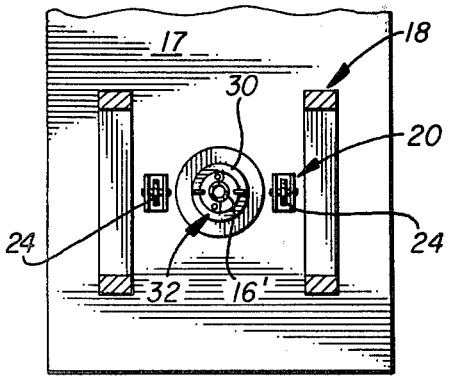
FIG. 6 is an enlarged, cross-sectional view taken along line 6—6 of FIG. 1; and, FIG. 7 is a broken, side elevational view which discloses the apparatus of FIGS. 2 and 3 in another operative configuration.
Figure 3:
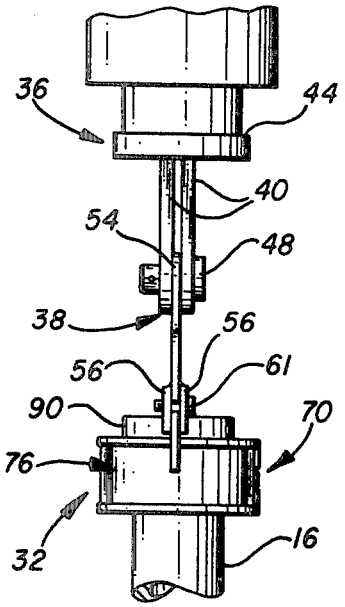
FIG. 3 is an assembled view of the apparatus disclosed in FIG. 2, with the apparatus being axially rotated 90°.

As seen in FIGS. 1–3, an adaptor device 34 includes a head engaging member 36 and a wishbone 38. The head engaging member has two downwardly depending, spaced, parallel web members 40 which are apertured at 42 and attached to a spreader plate 44. Male threads 46 are made complementary to the internal, female threaded surface of the member 29 of the powered head.

Pin 48 is received through holes 42 and 50, thereby pivotally tying together web members 70 and lug 52 of the before mentioned adaptor and wishbone. The lug 52 is affixed to a spreader bar 54. Spaced-apart pairs of ears 56 are apertured at 58. An oblated aperture 60 is formed through the upturned ears 62 of the before mentioned elevators 32 and 32', also referred to herein as the upper and lower elevators.

The elevators include a lower, split flange 64 attached to a hollow, cylindrical, split body member 66. Upper split flange 68 is attached to the split body members, while the before mentioned upturned ears 62 are attached to both the cylindrical body and the flanges of the elevator. Pin 61 is received through apertures 58 and 60 so that the inner marginal edge 77 formed by the upper face of the lower flange 64 engages the lower shoulder 69 formed by the collar 88 or 90 at the box end of each joint.

Bolt 74 is received through the spaced lugs 72 and 73, thereby forcing the opposed halves of the elevators towards one another, thereby frictionally engaging the outer peripheral surface of the collar and preventing relative rotation therebetween.

Figure 4:
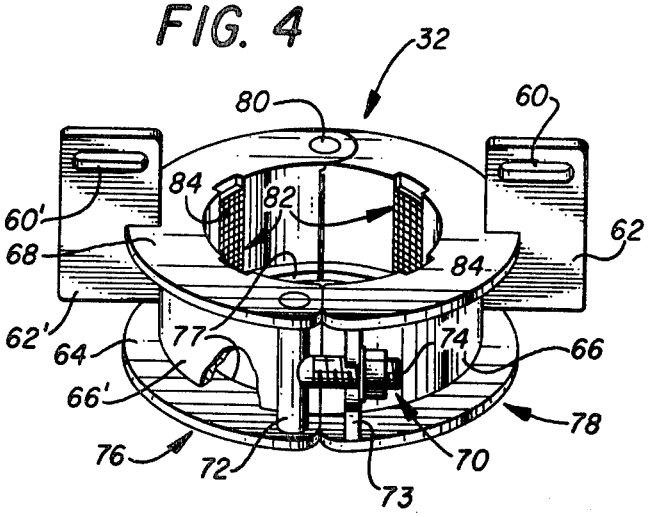
FIG. 4 is an enlarged, perspective view of part of the apparatus disclosed in FIGS. 2 and 3.
Figure 5:
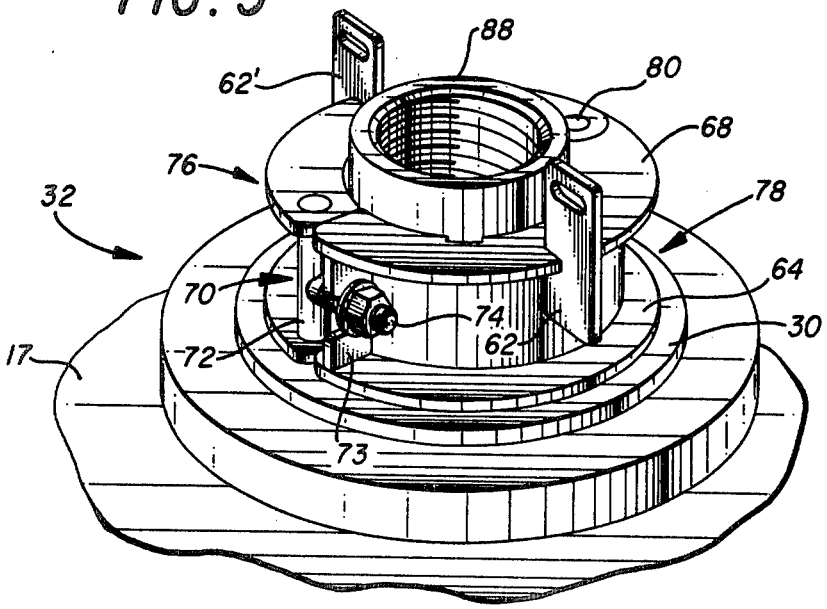
FIG. 5 is a perspective view which discloses an operational embodiment of the apparatus seen in FIG. 4.

As seen in FIG. 4, the elevator is bisected or split along a vertical longitudinal plane to provide opposed pivoted halves 76 and 78. Hinge pin 80 is placed through the apertured, overlapping, marginal edge portions of the upper and lower flanges so that the elevators can be opened to release a joint of casing therefrom. Radially spaced-apart, collar engaging dies 82 are secured within the elevator body and have a face 84 which bear against the exterior surface of the casing collar with great friction. The before mentioned lower flange inwardly extends at 77 past the face 84 of the dies to engage the collar shoulder while the dies simultaneously engage the exterior of the collar so that the lower flange lifts the string or joint while the dies prevent relative rotation between the elevator and collar.

In carrying out the method of the present invention, the head-engaging member 36 is threadedly made up with the rotating member 29 of the traveling head assembly 26. An elevator is attached to a casing joint, and the wishbone 38 is then pinned to the elevator. The casing joint can now be easily manipulated by pinning the wishbone to the adaptor 36 in the manner of FIG. 7. The joint can now be lifted into the derrick where it gravitates into axial alignment with the borehole.

Figure 7:
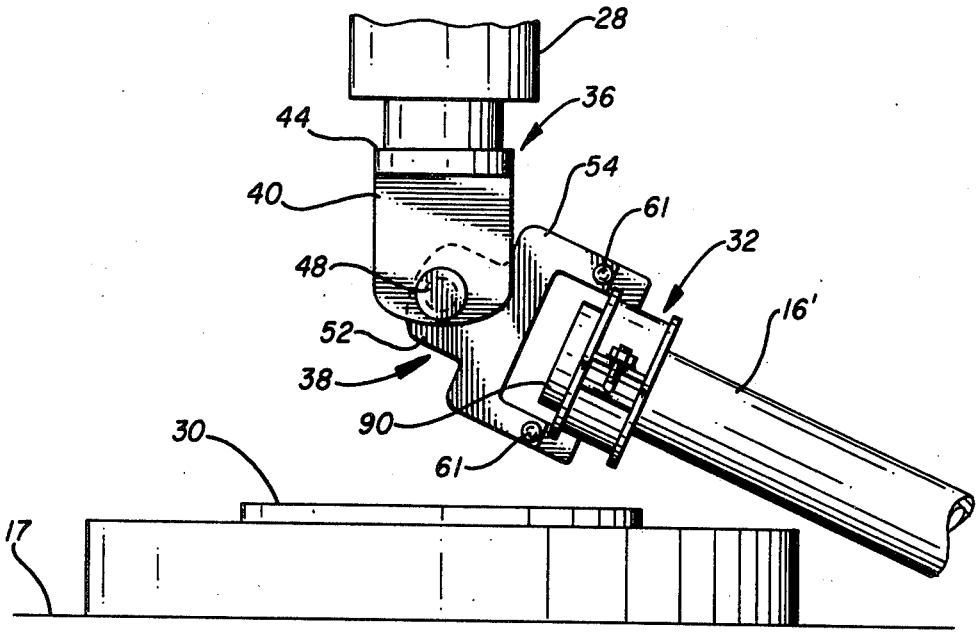

The casing string is made-up and run into the hole by placing a set of elevators 32 about the box end of a joint of casing, engaging the elevators with the adaptor, and lifting the casing by utilizing the traveling head in the manner of FIG. 7 so that the casing joint can be centered vertically within the derrick and then lowered into the borehole until the bottom flange 64 of the elevators is abuttingly engaged by the rig floor. The details of the apertured floor at 30 are unimportant so long as sufficient structural integrity is present to bottom support the elevators and absolutely avoid any possibility of the casing string falling downhole.

The last named elevator has thus become the lower elevator seen at 32 in FIGS. 1–3, with the lower elevator being attached to the upper end of the string of casing 16. Another elevator, 32', is attached to the next joint of casing to be added to the string, pulled up onto the rig floor, and pinned to the ears of the wishbone. This procedure enables the head engaging member 36 to pivotally accept the wishbone, elevator, and next joint of casing, with the next joint of casing being pivoted at pin 48 such that it is received at an inclined angle respective to the rig floor, as seen in FIG. 7 of the drawings.

The last joint of casing is picked up by the elevator and the lower pin end thereof is stabbed into the upper box end of the casing string. The powered head assembly rotates the adaptor apparatus, thereby imparting relative rotational motion between the string 16 and the joint of casing 16'. During this time, the ears 62 of the lower elevator are attached to structure associated with the floor of the drilling rig. After the joint and string have been made up, the powered head lifts the entire string a few inches uphole, the lower elevators are removed and placed onto the next joint of casing to be added to the string, while the traveling power head lowers the entire string downhole until the upper elevators 32' become the lower elevators 32. The next joint of casing is pulled up onto the rig floor and the above operation continued until the entire string is made-up and properly located downhole in the borehole, ready for the cementing job.

Tubular goods may be removed from the borehole and broke-out by reversing the above procedure.

In the above system of handling pipe, different size elevators must be employed for different size casing strings. The above method and apparatus can also be employed for handling upset tubing and other tubular goods. The elevators of the present invention serve as both the elevators as well as the slips. Employment of the present system enables longer joints of casing to be run into and out of the borehole; and accordingly, this effects a savings of both time and material, for the reason that the casing can be run faster, while at the same time, fewer box and pin ends are present in the string. When tubular goods are handled according to the method of the present invention, the number of workmen required to operate the rig is reduced from as many as ten to as few as three.

I claim:

1. In a drilling rig for performing wellbore operations, wherein the rig has a rotatable, traveling power head for attachment to the upper end of a pipe joint, and means on the rig floor for supporting the upper end of a pipe string which extends downhole into a borehole, the improvement comprising:

a lower elevator having means by which it can be removably attached to the upper end of a pipe string for supporting the pipe string at the rig floor, an upper elevator having means by which it can be removably attached to the upper end of a pipe joint; adaptor means by which said upper elevator can support the pipe joint from the power head;

said lower elevator includes opposed, outwardly extending lug means for holding said lower elevator against axial rotation; said upper elevator includes opposed, outwardly extending lug means by which said adaptor means enables rotation of the power head to rotate said upper elevator so that said upper elevator imparts axial rotation into the pipe joint;

whereby one elevator can be attached to the upper end of a pipe joint with the adaptor means also connecting the elevator to the power head, so that when the axial centerline of the pipe joint and pipe string lie along a common axial centerline, the pipe joint can be rotated respective to the pipe string to thereby make up or break out the pipe string while going into and out of the borehole, and a second elevator simultaneously supports the pipe string at the rig floor.

2. The improvement of claim 1 wherein said upper and lower elevators are substantially identical in construction.

3. The improvement of claim 2 wherein said adaptor means includes an adaptor sub and a wishbone, said adaptor sub has means at one end thereof by which said sub is removably attached to the power head; said wishbone has means at the upper end thereof by which said wishbone is pivotally attached to a lower end of said sub, and means by which the lower end of said wishbone is attached to the lugs of the upper elevator.

4. The improvement of claim 3 wherein said upper and lower elevators are of cylindrical configuration, each elevator is bisected to form first and second semicircular bodies hinged together to receive the pipe therewithin, each said elevator has radially spaced slips formed on the inner surface of said bodies for frictionally engaging the outer surface of a pipe collar, and a flange at the lower end thereof for abuttingly engaging the shoulder of a collar.

5. The improvement of claim 1 wherein said adaptor means includes an adaptor sub and a wishbone, said adaptor sub has means at one end thereof by which said sub is removably attached to the power head; said wishbone has means at the upper end thereof by which said wishbone is attached to the lower end of said sub, and means at the lower end thereof by which said wishbone is attached to said elevator.

6. The improvement of claim 1 wherein said upper and said lower elevators are of cylindrical configuration and are each bisected to form first and second semicircular bodies hinged together to receive the pipe therewithin, each said elevator has radially spaced slips formed on the inner surface of said bodies for frictionally engaging the outer surface of a pipe collar, and a flange at the lower end thereof for abuttingly engaging the shoulder of a collar.

7. In a rig for forming borehole operations, said rig having a power head, and an elevator support means at the floor thereof, the method of running tubular members into and out of the borehole comprising the steps of:

(1) removably attaching a lower elevator to the upper end of a pipe string which is located in the borehole, and engaging the string with sufficient force to prevent rotation thereof respective to the floor of the rig, while the elevator also supports the string at the floor of the rig;

(2) removably attaching an upper elevator to the upper end of a joint of pipe;

(3) removably attaching said upper elevator to the power head so that rotation of the head causes relative rotation between the joint and the string;

(4) adding said joint of pipe to the string by manipulating the head until the upper end of the string and the lower end of the joint are mated, and screwing the joint onto the string by rotating the head;

(5) removing the lower elevator, lowering the head until the upper elevator supports the string at the floor, thereby becoming a lower elevator;

(6) attaching an elevator other than the last said lower elevator to another joint of pipe;

(7) removably attaching the elevator of step 6 to the power head so that rotation of the head causes relative rotation between the last said joint and the string;

(8) adding the last said joint to the string by manipulating the head until the upper end of the string and the lower end of the joint are mated, and screwing the joint onto the string by rotating the head;

(9) continuing in the above manner until the string is made up.

8. The method of claim 7 wherein the string is subsequently removed from the borehole and broke out into joints according to the following steps:

(10) removably attaching an elevator to the upper end of a pipe string with sufficient force to prevent rotation between the elevator and the string as the string is broke out;

(11) removably attaching said elevator to the power head and lifting the string by the elevator until a joint is above the rig floor;

(12) removably attaching another elevator to the upper end of the joint of the string which underlies the joint located above the floor;

(13) rotating the upper elevator with the head while holding the lower elevator so that the joint is removed from the string;

(14) removing the upper elevator from the head so that the joint can be removed from the rig;

(15) lifting the remaining string by attaching the head to the lower elevator until another joint is located above the floor;

(16) removably attaching an elevator other than the last elevator to the upper end of the joint which underlies the uppermost joint;

(17) carrying out the above steps until the string has been removed from the hole.

9. The method of claim 8 wherein the pipe joints each have a coupling member on the upper end thereof by which the joints are connected together, and lifting the joint by engaging the shoulder of the coupling member with the elevator while the collar of the joint is frictionally engaged by the inner body of the elevator.

10. The method of claim 9 wherein an adaptor is used to attach the upper elevator to the power head so that a maximum of space is provided between the head and the floor to thereby accommodate a maximum length of a joint of pipe.

11. The method of claim 7 wherein the pipe joints each have a coupling member on the upper end thereof by which the joints are connected together, and further including the step of engaging the coupling members with a lower flange of the elevator while the exterior surface of the collar is frictionally engaged by the inner body of the elevator so that the joints of pipe can be manipulated with minimum damage occurring thereto.

12. The method of claim 7 wherein an adaptor is used to attach an elevator to the power head so that a maximum of space is provided between the head and the floor to thereby accommodate a maximum length of pipe.

13. In a drilling rig for performing wellbore operations, wherein the rig has a rotatable, traveling power head for attachment to the upper end of a pipe joint, and support means located on the rig floor for supporting the upper end of a pipe string which extends downhole into a borehole, the combination with said drilling rig of pipe handling apparatus;

said pipe handling apparatus comprises an upper and a lower elevator, each of said elevators having means by which it can be removably attached to the upper end of a pipe joint;

means on each of said elevators for preventing relative rotation between a pipe joint and the elevators, and for engaging and lifting a pipe joint;

an adaptor means; opposed, outwardly extending lug means on each of said elevators by which the adaptor means engages the upper elevator and enables rotation of the power head to rotate said upper elevator, so that the upper elevator imparts axial rotational motion into the pipe joint; said lug means also enables said lower elevator to engage the support means at the rig floor to prevent the pipe string from rotating;

whereby said upper elevator can be attached to the upper end of a pipe joint, the adaptor means can be connected to the elevator and to the power head so that when the power head lifts the joint to cause the axial centerline of the pipe joint and pipe string to lie along a common axial centerline, the pipe joint can be rotated respective to the pipe string by the power head to thereby make up or break out the pipe string while going into and out of the borehole.

* * * * *